US010530041B2

(12) United States Patent
Jung et al.

(10) Patent No.: US 10,530,041 B2
(45) Date of Patent: Jan. 7, 2020

(54) ELECTRONIC DEVICE COMPRISING ANTENNA

(71) Applicant: Samsung Electronics Co., Ltd., Suwon-si, Gyeonggi-do (KR)

(72) Inventors: Sang Min Jung, Anyang-si (KR); Min Ho Soh, Suwon-si (KR); Hyun Kim, Seoul (KR); Gwang Un Oh, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 203 days.

(21) Appl. No.: 15/374,213

(22) Filed: Dec. 9, 2016

(65) Prior Publication Data

US 2017/0264003 A1 Sep. 14, 2017

(30) Foreign Application Priority Data

Mar. 10, 2016 (KR) ..... 10-2016-0029145

(51) Int. Cl.
*H01Q 1/24* (2006.01)

(52) U.S. Cl.
CPC ..... *H01Q 1/243* (2013.01)

(58) Field of Classification Search
CPC ..... H01Q 1/243; H01Q 5/328; H01Q 1/42
See application file for complete search history.

(56) References Cited

U.S. PATENT DOCUMENTS

2013/0154897 A1* 6/2013 Sorensen ..... H01Q 7/005 343/861
2013/0194139 A1* 8/2013 Nickel ..... H01Q 5/328 343/703
2013/0203364 A1* 8/2013 Darnell ..... H01Q 1/243 455/77
2013/0257659 A1* 10/2013 Darnell ..... H01Q 1/243 343/702
2016/0141767 A1 5/2016 Zhai et al.

FOREIGN PATENT DOCUMENTS

KR 1020150082840 * 6/2015
KR 10-2016-0015292 A 2/2016

* cited by examiner

*Primary Examiner* — Hoang V Nguyen
*Assistant Examiner* — Awat M Salih
(74) *Attorney, Agent, or Firm* — Jefferson IP Law, LLP

(57) ABSTRACT

An electronic device is provided. The electronic device includes an antenna radiator, a first feeding terminal configured to supply a first frequency band signal to the antenna radiator, a second feeding terminal configured to supply a second frequency band signal to the antenna radiator, and a plurality of grounds electrically connected with the antenna radiator. The first feeding terminal is connected with the antenna radiator and at least one of the plurality of grounds through a passive circuit including a plurality of electrical paths.

10 Claims, 10 Drawing Sheets

ELECTRONIC DEVICE COMPRISING ANTENNA

CROSS-REFERENCE TO RELATED APPLICATION(S)

This application claims the benefit under 35 U.S.C. § 119(a) of a Korean patent application filed on Mar. 10, 2016 in the Korean Intellectual Property Office and assigned Serial number 10-2016-0029145, the entire disclosure of which is hereby incorporated by reference.

TECHNICAL FIELD

The present disclosure relates to an electronic device comprising an antenna.

BACKGROUND

Along with advancement of mobile communication technology, electronic devices have been evolved to be easily connectable with many kinds of wired/wireless communication networks, as well as portable in convenience. For instance, portable electronic devices, such as smartphones or tablet computers, not only support diverse functions based on applications installed therein but also perform data communications through wired/wireless communication networks. For connection with wireless communication networks, electronic devices are provided with the technology of diversity and multiple-input multiple-output (MIMO) antenna. Additionally, the technologies of 4th generation (4G) diversity, carrier aggregation (CA), and 2×2 MIMO are further applied to such electronic devices in various modes.

In the meantime, back covers and bezels forming the exterior of electronic devices are fabricated with metallic materials. Back covers and bezels made of metallic materials are highly preferred by consumers in virtue of their own brilliance and durability. Since antennas embedded in an electronic device are usually set to transmit or receive signals with a plurality of frequency bands and placed in the inner spaces of the electronic device, the antennas may be arranged close to each other. In the case of transmitting or receiving a plurality of frequency band signals through such closely arranged antennas in an electronic device, there could be interference between those signals. Interference between signals could cause general degradation of antenna function.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device including a passive circuit for improving isolation between pluralities of frequency band signals.

In accordance with an aspect of the present disclosure, an electronic device is provided. The electronic device includes an antenna radiator, a first feeding terminal configured to supply a first frequency band signal to the antenna radiator, a second feeding terminal configured to supply a second frequency band signal to the antenna radiator, and a plurality of grounds electrically connected with the antenna radiator. The first feeding terminal may be connected with the antenna radiator and at least one of the plurality of grounds through a passive circuit including a plurality of electrical paths.

In accordance with another aspect of the present disclosure, an electronic device is provided. The electronic device includes an antenna radiator, a first feeding terminal and a second feeding terminal configured to feed the antenna radiator, a passive circuit arranged between the first feeding terminal and the antenna radiator, and a communication circuit electrically connected with the first feeding terminal and the second feeding terminal. The communication circuit may be configured to transmit or receive a first frequency band signal through a first electrical path that is formed of the first feeding terminal and at least a part of the antenna radiator, and transmit or receive a second frequency band signal through a second electrical path that is formed of the second feeding terminal and at least a part of the antenna radiator. The passive circuit may be configured to enhance isolation between the first frequency band signal and the second frequency band signal.

In accordance with another aspect of the present disclosure, an electronic device is provided. The electronic device includes a first antenna radiator, a second antenna radiator, a first insulating member arranged between the first antenna radiator and the second antenna radiator, a first feeding terminal and a second feeding terminal configured to feed the first antenna radiator, a passive circuit arranged between the first feeding terminal and the first antenna radiator, and a communication circuit electrically connected with the first feeding terminal and the second feeding terminal. The communication circuit may be configured to transmit or receive a first frequency band signal through a first electrical path that is formed of the first feeding terminal, the first antenna radiator, and the second antenna radiator, and transmit or receive a second frequency band signal through a second electrical path that is formed of the second feeding terminal and the first antenna radiator. The passive circuit may be configured to enhance isolation between the first frequency band signal and the second frequency band signal.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
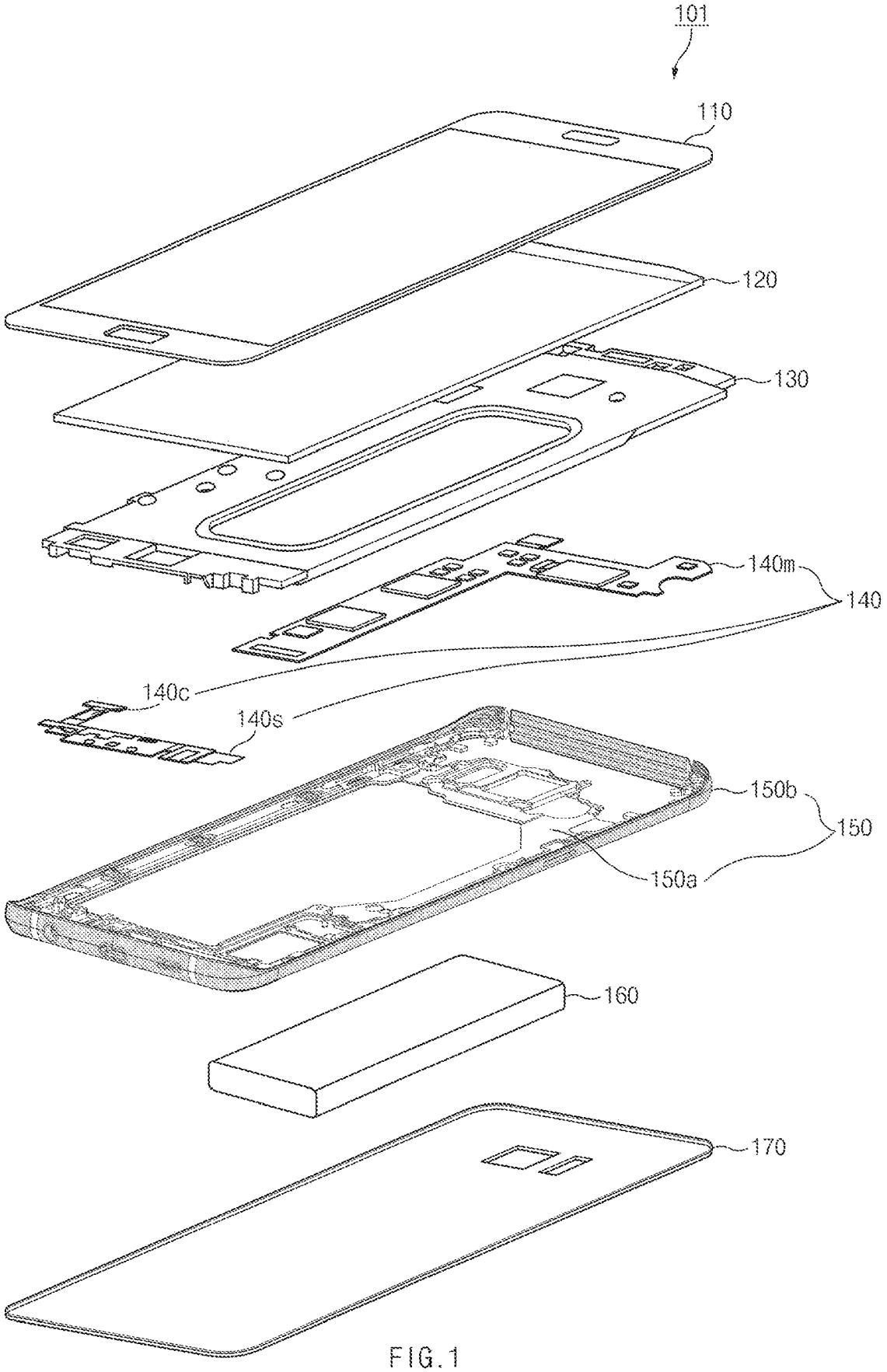
FIG. 1 is an explored perspective view illustrating an electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The terms "have", "may have", "include", "may include", "comprise", or "may comprise" used herein indicate existence of corresponding features (e.g., numerical values, functions, operations, or components) but does not exclude other features.

As used herein, the terms "A or B", "at least one of A or/and B", or "one or more of A or/and B" may include all allowable combinations which are enumerated together. For example, the terms "A or B", "at least one of A and B", or "at least one of A or B" may indicate all cases of: (1) including at least one A, (2) including at least one B, or (3) including both at least one A, and at least one B.

As used herein, the terms such as "1st", "2nd", "first", "second", and the like may be used to qualify various elements regardless of their order and/or priority, simply differentiating one from another, but do not limit those elements thereto. For example, both a first user device and a second user device indicate different user devices. For example, a first element may be referred to as a second element and vice versa without departing from the scope of the present disclosure.

As used herein, if one element (e.g., a first element) is referred to as being "operatively or communicatively connected with/to" or "connected with/to" another element (e.g., a second element), it should be understood that the former may be directly coupled with the latter, or connected with the latter via an intervening element (e.g., a third element). Otherwise, it will be understood that if one element is referred to as being "directly coupled with/to" or "directly connected with/to" with another element, it may be understood that there is no intervening element (e.g., a third element) existing between them.

In the description or claims, the term "configured to" (or "set to") may be changeable with other implicative meanings such as "suitable for", "having the capacity to", "designed to", "adapted to", "made to", or "capable of", and may not simply indicate "specifically designed to". Alternatively, in some circumstances, a term "a device configured to" may indicate that the device "may do" something together with other devices or components. For instance, a term "a processor configured to (or set to) perform A, B, and C" may indicate a generic-purpose processor (e.g., central processing unit (CPU) or application processor (AP)) capable of performing its relevant operations by executing one or more software or programs which is stored in an exclusive processor (e.g., embedded processor), which is prepared for the operations, or in a memory.

The terms used in this specification are just used to describe various embodiments of the present disclosure and may not be intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevantly related art and not in an idealized or overly formal detect unless expressly so defined herein in various embodiments of the present disclosure. In some cases, terms even defined in the specification may not be understood as excluding embodiments of the present disclosure.

An electronic device according to various embodiments of the present disclosure may include, for example, at least one of smartphones, tablet personal computers (tablet PCs), mobile phones, video telephones, electronic book readers, desktop PCs, laptop PCs, netbook computers, workstations, servers, personal digital assistants (PDAs), portable multimedia players (PMPs), Moving Picture Experts Group phase 1 or phase 2 (MPEG-1 or MPEG-2) audio layer 3 (MP3) players, mobile medical devices, cameras, wearable devices. According to various embodiments of the present disclosure, the wearable devices may include at least one of accessories (e.g., watches, rings, bracelets, anklets, necklaces, glasses, contact lenses, or head-mounted devices (HMDs)), assembled textiles or clothes (e.g., electronic apparel), body-attachable matters (e.g., skin pads or tattoos), or implantable devices (e.g., implantable circuits).

In some embodiments of the present disclosure, an electronic device may be a smart home appliance. The smart home appliance, for example, may include at least one of televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, Google TV™, and the like), game consoles (e.g., Xbox™, PlayStation™, and the like), electronic dictionaries, electronic keys, camcorders, electronic picture frames, and the like.

In other embodiments of the present disclosure, an electronic device may include at least one of diverse medical devices portable medical measuring instruments (blood-sugar measuring instruments, heart-pulsation measuring instruments, blood-pressure measuring instruments, or body-temperature measuring instruments), magnetic resonance angiography (MRA) equipment, magnetic resonance imaging (MRI) equipment, computed tomography (CT) equipment, scanners, and ultrasonic devices), navigation device, global positioning system (GPS) receiver, event data recorder (EDR), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs) for financial agencies, points of sales (POSs) for stores, and internet of things electric bulbs, diverse sensors, electric or gas meter, spring cooler units, fire alarms, thermostats, road lamps, toasters, exercise implements, hot water tanks, boilers, and the like).

According to some embodiments of the present disclosure, an electronic device may include at least one of parts of furniture or buildings/structures having communication functions, electronic boards, electronic-signature receiving devices, projectors, and diverse measuring instruments (e.g., water meters, electricity meters, gas meters, and wave meters) including metal cases. In various embodiments of the present disclosure, an electronic device may be one or more combinations of the above-mentioned devices. Electronic devices according to some embodiments of the present disclosure may be flexible electronic devices. Additionally, electronic devices according to various embodiments of the present disclosure may not be restrictive to the above-mentioned devices, rather may include new electronic devices emerging by way of technical development.

Hereinafter, an electronic device according to various embodiments of the present disclosure will be described in conjunction with the accompanying drawings. In description for various embodiments of the present disclosure, the term "user" may refer to a person using an electronic device or a device (e.g., an artificial intelligent electronic device) using an electronic device.

FIG. 1 is an explored perspective view illustrating an electronic device according to an embodiment of the present disclosure.

Referring to FIG. 1, an electronic device 101 according to an embodiment of the present disclosure may include a front cover glass 110, a display 120, a bracket 130, a circuit board 140, a housing 150, a battery 160, and a back cover 170. According to various embodiments of the present disclosure, the electronic device 101 may exclude a part of configuration shown in FIG. 1 or even include additionally a configuration which is not shown in FIG. 1 (see FIGS. 8 and 9).

The front cover glass 110 may penetrate light which is generated from the display 120. Additionally, a user may touch the front cover glass 110 by a part of his body (e.g., finger) (including a touch using an electronic pen). The front cover glass 110 may be formed of, for example, tempered glass, reinforced plastic, or flexible polymer to protect the display 120 and the electronic device 101, which is equipped with the display 120, from external impacts. According to various embodiments of the present disclosure, the front cover glass 110 may be referred to even as a glass window.

The display 120 may output content (e.g., text, image, video, icon, widget, or symbol) or may receive a touch input (touch, gesture, hovering, or force touch). For this operation, the display 120 may include a display panel, a touch panel, and/or an input sensor. For example, at least one of the display panel, the touch panel, and/or the input sensor may be attached to other configurations through an optical clean adhesive.

According to an embodiment of the present disclosure, a display panel of the display 120 may include a liquid crystal display (LCD) panel, a light emitting diode (LED) display panel, an organic LED (OLED) panel, or a micro electromechanical system (MEMS) display panel, or an electronic paper display panel. Additionally, for example, a touch panel of the display 120 may include an electrostatic touch panel, a decompressive touch panel, a resistive touch panel, an infrared touch panel, or an ultrasonic touch panel.

The bracket 130 may be arranged, for example, under the display 120 and on the circuit board 140. The bracket 130 may physically support the display 120 and the circuit board 140 in combination with them.

The circuit board 140 may include, for example, a main circuit board 140*m*, a sub circuit board 140*s*, and a connector 140*c* which connects the main circuit board 140*m* with the sub circuit board 140*s*. The main circuit board 140*m* and the sub circuit board 140*s* may be implemented, for example, in a flexible printed circuit board (FPCB) or a PCB. According to an embodiment of the present disclosure, the circuit board 140 may be equipped with various kinds of electronic components, elements, and printed circuits. According to various embodiments of the present disclosure, the circuit board 140 may be referred to as a main board.

The housing 150 may form the interior and/or the exterior of the electronic device 100 of the electronic device 101. The housing 150 may be referred to even as a rear case, a rear housing, a rear plate, or simply "rear". The housing 150 may include a first area 150*a* which is not exposed to the outside of the electronic device 101, and a second area 150*b* which is exposed to the outside of the electronic device 101. For example, the first area 150*a* may be formed of an injection molded product which prevents the circuit board 140 from exposure when detaching the back cover 170. The second area 150*b* may correspond to, for example, a bezel which forms a side of the electronic device 101. The bezel made of metallic material may be referred to as a metallic bezel. According to an embodiment of the present disclosure, at least a part of the second area 150*b* may be utilized as an antenna radiator for transmitting or receiving a specific frequency signal.

The battery 160 may convert chemical and electrical energy bilaterally. For example, the battery 160 may convert chemical energy into electrical energy which is to be supplied to many modules equipped in the display 120 and the circuit board 140. Otherwise, the battery 160 may also convert electrical energy, which is supplied from an external source, into chemical energy to be stored. The circuit board 140 may be equipped with a power management module for managing a charge/discharge of the battery 160.

The back cover 170 may be combined with the backside of the housing 150 (opposite to the surface on which the display 120 is arranged). The back cover 170 may be made of a tempered glass, a plastic injection molded product, and/or a metallic material. According to various embodiments of the present disclosure, the back cover 170 may be formed in one body with the housing 150, or may be implemented even in an attachable form.

Figure 2A:
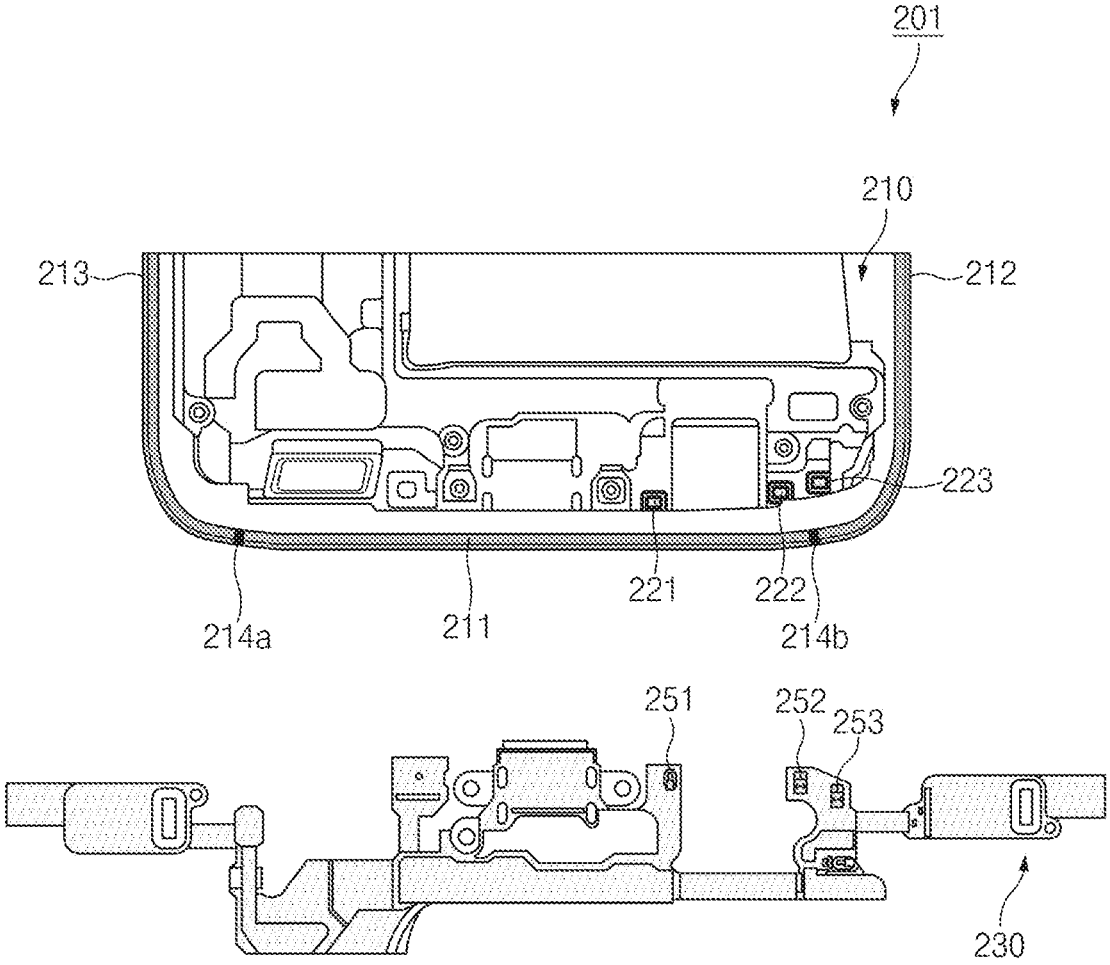
FIG. 2A illustrates a structure in which a circuit board is combined with a housing of an electronic device according to an embodiment of the present disclosure.

FIG. 2A illustrates a structure in which a circuit board is combined with a housing of an electronic device 201 according to an embodiment of the present disclosure.

Referring to FIG. 2A, an electronic device is shown according to an embodiment of the present disclosure. A circuit board 230 of an electronic device according to an embodiment of the present disclosure may be combined with a housing 210. For example, the housing 210 and the circuit board 230 may correspond to the housing 150 and the sub circuit board 140*s* which are illustrated in FIG. 1.

In the housing 210, an area exposed to the outside may include a first conductive member 211, a second conductive member 212, a third conductive member 213, a first insulating member 214*a*, and a second insulating member 214*b*. The conductive members 211, 212, and 213 may be implemented in at least a part of the housing 210.

For example, the first conductive member 211 may be arranged on the underside of the housing 210, and the second conductive member 212 and the third conductive member 213 may be arranged at the left and right sides of the housing 210 (i.e., bezel). The first insulating member 214*a* may be arranged between the first conductive member 211 and the third conductive member 213. The second insulating member 214*b* may be arranged between the first conductive member 211 and the second conductive member 212.

According to an embodiment of the present disclosure, the first conductive member 211, the second conductive member 212, and the third conductive member 213 may be utilized as an antenna radiator for transmitting or receiving a specific frequency signal. Accordingly, in the present disclosure, the first conductive member 211, the second conductive member 212, and the third conductive member 213 may be referred to as a first antenna radiator, a second antenna radiator, and a third antenna radiator, respectively.

According to an embodiment of the present disclosure, the first insulating member 214*a* and the second insulating member 214*b* may be implemented, for example, in a dielectric material which has conductance equal to or lower than a specific value. The first insulating member 214*a* may prevent a direct contact between the first conductive member 211 and the third conductive member 213. The second insulating member 214*b* may prevent a direct contact between the first conductive member 211 and the second conductive member 212. The first conductive member 211 and the third conductive member 213 may be electromechanically (or electrically) coupled to each other through the first insulating member 214*a*. The first conductive member 211 and the second conductive member 212 may be electromechanically coupled to each other through the second insulating member 214*b*. According to various embodiments of the present disclosure, the insulating members 214*a* and 214*b* may be referred to as segmental parts.

According to an embodiment of the present disclosure, in the housing 210, an area unexposed to the outside may include a structure for allowing an electrical and physical combination with a circuit board 230. According to an embodiment of the present disclosure, a plurality of contact patches 221, 222, and 223 may be arranged at the lower end of the area unexposed to the outside.

The plurality of contact patches 221, 222, and 223 may be electrically connected with at least one of the first conductive member 211, the second conductive member 212, and the third conductive member 213. The plurality of contact patches 221, 222, and 223 may be electrically connected each other in contact respectively with a plurality of connectors 251, 252, and 253. Through connection between the plurality of contact patches 221, 222, and 223 and the plurality of connectors 251, 252, and 253, diverse configurations (e.g., feeding terminals, grounds, passive circuits, etc.) mounted on the circuit board 230 may be electrically connected with the plurality of conductive members 211, 212, and 213.

The circuit board 230 may include a communication circuit, a feeding terminal, a ground, or a passive circuit. According to an embodiment of the present disclosure, a communication circuit may be mounted even on another circuit substrate (e.g., the main circuit board 140*m* of FIG. 1) different from the circuit board 230. According to an embodiment of the present disclosure, the rear side of the circuit board 230 may include a plurality of connectors 251, 252, and 253. The plurality of connectors 251, 252, and 253 may be implemented in various kinds of connection members such as C-clip, conductive tape, conductive elastomer, and so on.

Figure 2B:
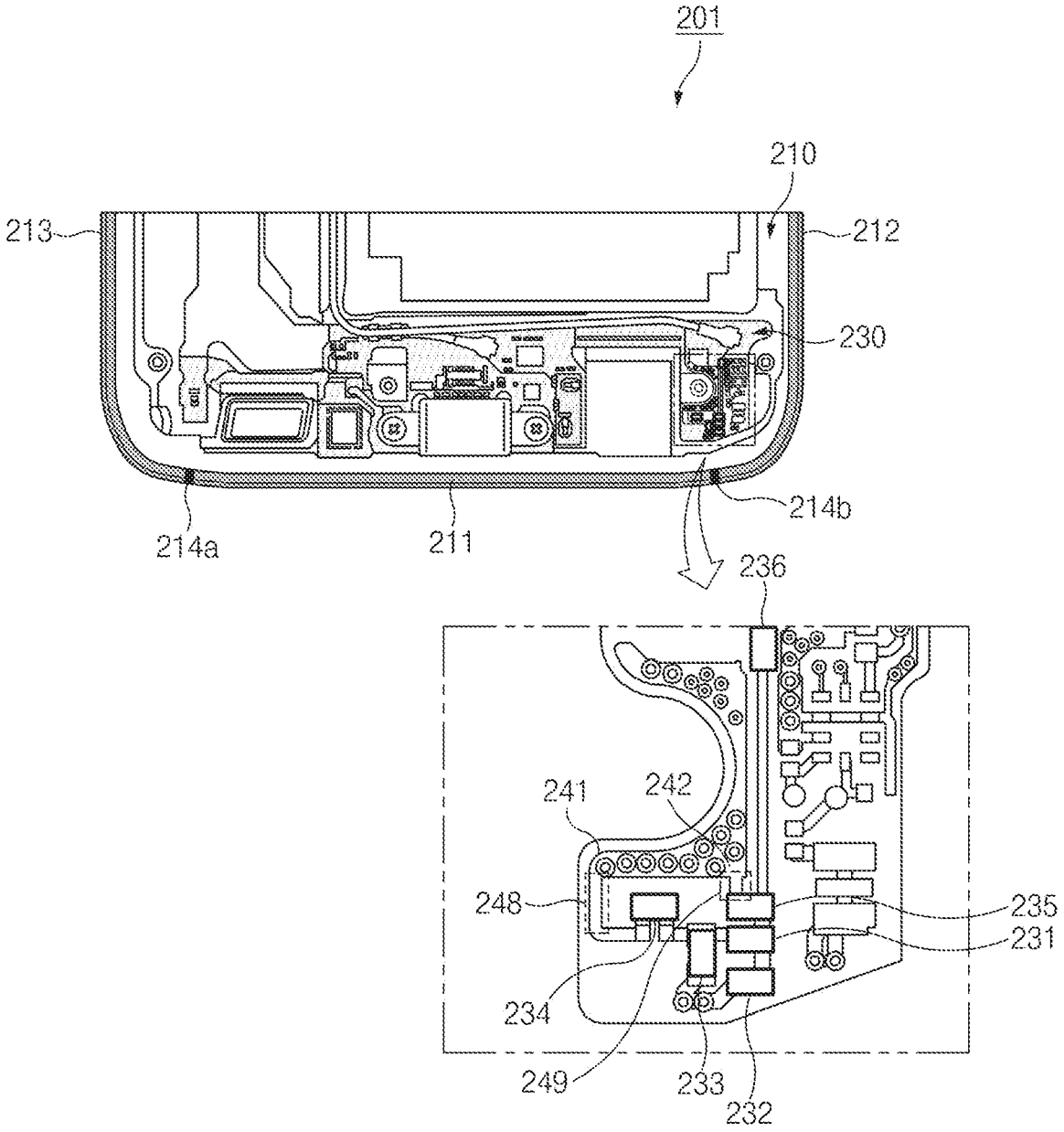
FIG. 2B illustrates a structure in which a passive circuit is installed in a circuit board according to an embodiment of the present disclosure.

FIG. 2B illustrates a structure in which a passive circuit is installed in a circuit board in accordance with an embodiment of the present disclosure.

Referring to FIG. 2B, an electronic device 201 is partly shown in a structure where a circuit board is combined with a housing. For example, the electronic device 201 shown in FIG. 2B may be referred to as the structure where the housing 210 of FIG. 2A is combined with the circuit board 230. With respect to FIG. 2A, duplicative description will be omitted hereafter.

The circuit board 230 may include a passive circuit which is designed to enhance isolation between different frequency band signals. The passive circuit may include a plurality of electrical paths. The plurality of electrical paths may be arranged with at least one passive element (e.g., reactance element). The passive element may be also referred to a lumped element, or may be referred to as microstrip lines which have variable lengths and widths.

According to an embodiment of the present disclosure, a passive circuit implemented on the circuit board 230 may include a first reactance element 231, a second reactance element 232, a third reactance element 233, a fourth reactance element 234, a fifth reactance element 235, and a sixth reactance element 236.

According to an embodiment of the present disclosure, the first reactance element 231, the second reactance element 232, and the third reactance element 233 may be connected with delta (Δ) connection. A first node may be formed between the first reactance element 231 and the third reactance element 233. A second node may be formed between the second reactance element 232 and the third reactance element 233. A third node may be formed between the second reactance element 232 and the third reactance element 233.

According to an embodiment of the present disclosure, the fourth reactance element 234 may be arranged between a first ground 241 and the first node in series. Additionally, the fifth reactance element 235 may branch out from the second node and may be arranged between the second node and the second ground 242 in series. The sixth reactance element 236 may be arranged between the second node and a first feeding terminal in series (not shown).

According to an embodiment of the present disclosure, the third node between the second reactance element 232 and the third reactance element 233 may be electrically connected with at least one of antenna radiators 211, 212, and 213 through at least one of connectors (e.g., 251, 252, and 253 of FIG. 2A) which are arranged at the backside of the circuit board 230.

Although FIG. 2B illustrates the first ground 241 and the second ground 242 are formed individually, according to an embodiment of the present disclosure, the first ground 241 and the second ground 242 may be integrated even on a single ground. Additionally, an area 248 elongated from the first ground 241 and an area 249 elongated from the second ground 242 may be utilized for frequency band tuning by adjusting lengths and widths thereof.

The aforementioned arrangement of the elements 231 to 236 are not restricted to the embodiment shown in FIG. 2B. A passive circuit implemented in the circuit board 230 will be described in more detail in conjunction with FIGS. 3 and 4.

Figure 3:
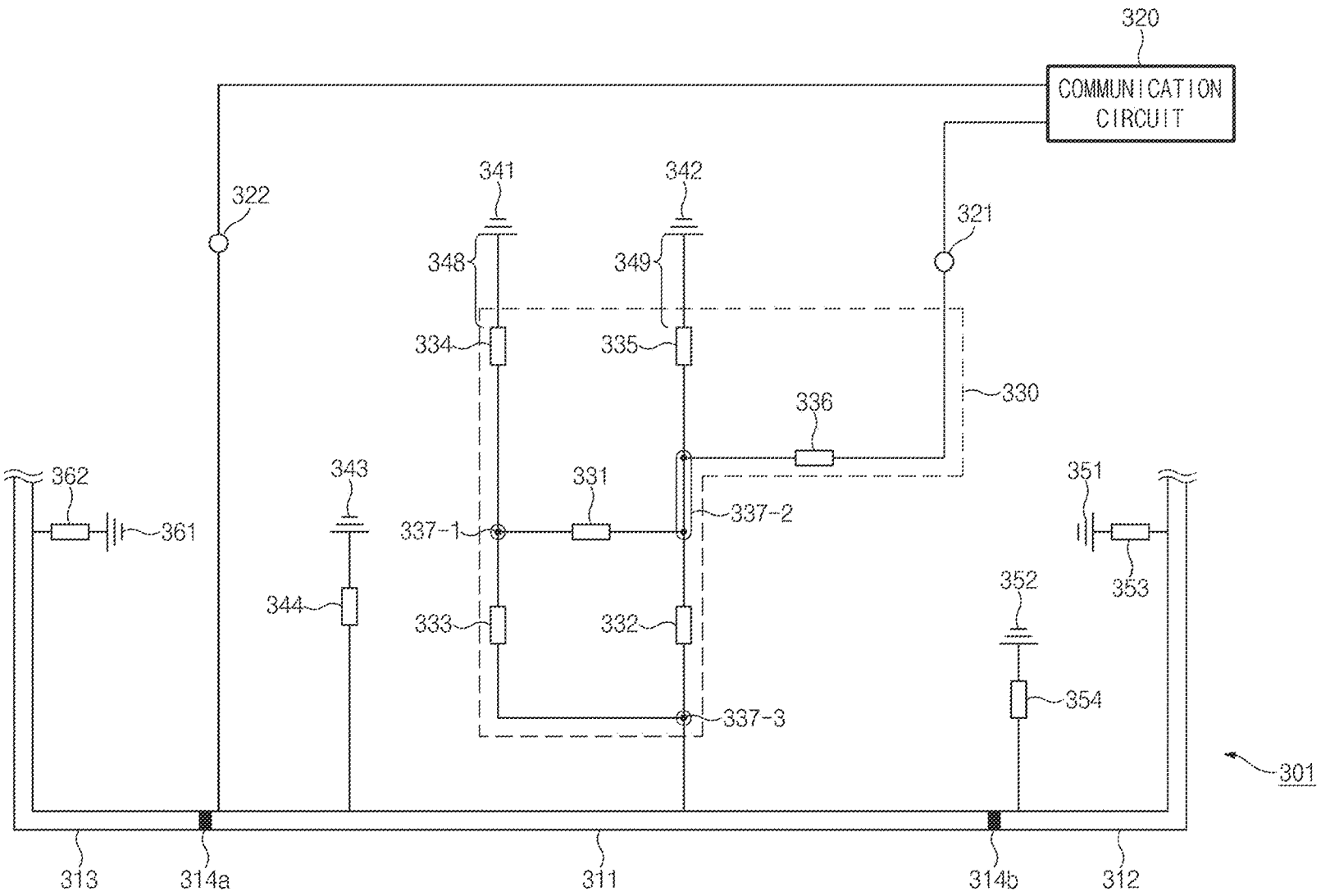
FIG. 3 is a circuit diagram illustrating a part of an electronic circuit according to an embodiment of the present disclosure.

FIG. 3 is a circuit diagram illustrating a part of an electronic circuit according to an embodiment of the present disclosure.

Referring to FIG. 3, an electronic device 301 according to an embodiment of the present disclosure may include a first antenna radiator 311, a second antenna radiator 312, a third antenna radiator 313, a first insulating member 314*a*, a second insulating member 3141*b*, a communication circuit 320, a passive circuit 330, a first feeding terminal 321, a second feeding terminal 322, and a plurality of grounds 341, 342, 343, 351, 352, and 361. With respect to FIG. 3, the description relevant to FIGS. 2A and 2B will not be further described hereafter.

According to an embodiment of the present disclosure, the first antenna radiator 311 and the third antenna radiator 313 may be electrically (or electromagnetically) coupled via a first insulating member 314*a* which is arranged between them. Similarly, the first antenna radiator 311 and the second antenna radiator 312 may be electrically (or electromagnetically) coupled via a second insulating member 314*b* which is arranged between them.

According to an embodiment of the present disclosure, the first antenna radiator 311 may be electrically connected with the first feeding terminal 321, the first ground 341, and the second ground 342 through the passive circuit 330 at a spot. The first antenna radiator 341 may be electrically connected with the third ground 343 through a reactance element 344 at another spot. Additionally, according to an embodiment of the present disclosure, the second antenna radiator 312 may be electrically connected with the fourth ground 351 through a reactance element 353 at a spot. Additionally, the third antenna radiator 313 may be electrically connected with the fifth ground 361 through a reactance element 362 at a spot.

A communication circuit 320 may be electrically connected with the first feeding terminal 321 and the second feeding terminal 321. The communication circuit 321 may supply a first frequency band signal and a second frequency band signal respectively to the first feeding terminal 321 and the second feeding terminal 322. For example, the first frequency band may include an intermediate frequency band (e.g., 1.7~2.2 GEL) and a high frequency band (e.g., 2.5~2.8 GHz). The second frequency band may correspond to a low frequency band (e.g., 700~900 MHz) lower than the first frequency band. According to various embodiments of the present disclosure, the communication circuit 320 may be set to transmit or receive the first frequency band signal and the second frequency band signal in a multiple-input multiple-output (MIMO) scheme, or even using carrier aggregation (CA).

According to an embodiment of the present disclosure, the communication circuit 320 may transmit or receive a first frequency signal through a first electrical path which is formed of the first feeding terminal 321, the passive circuit 330, at least a part (e.g., the first antenna radiator 311) of the antenna radiators, and/or the second antenna radiator 312. Additionally, the communication circuit 320 may transmit or receive a second frequency band signal through a second electrical path which is formed of the second feeding terminal 322 and at least a part (e.g., the first antenna radiator 311) of the antenna radiators. The communication circuit 320 may transmit or receive a third frequency band signal through a third electrical path which is formed of the second feeding terminal 322 and at least a part (e.g., the first antenna radiator 311 and the third antenna radiator 313) of the antenna radiators. The third frequency band signal may correspond to a frequency band adjacent to the second frequency band.

The first feeding terminal 321 and the second feeding terminal 322 may supply a first frequency band signal and a second frequency band signal to the antenna radiators 311, 312, and 313. For example, the first feeding terminal 321 may be connected with the first antenna radiator 311 through the passive circuit 330. The second feeding terminal 322 may be connected with the second antenna radiator 312.

The passive circuit 330 may be designed to enhance isolation between a first frequency band signal and a second frequency band signal. The passive circuit 330 may be arranged between the first feeding terminal 321 and the first antenna radiator 311. The passive circuit 330 may include a plurality of electrical paths and the plurality of electrical paths may include at least one passive element.

According to an embodiment of the present disclosure, the passive circuit 330 may include delta-connected three reactance elements 331, 332, and 333. A first node 337-1 may be formed between the first reactance element 331 and the third reactance element 333. A second node 337-2 may be formed between the first reactance element 331 and the second reactance element 332. A third node 337-3 may be formed between the second reactance element 332 and the third reactance element 333. The first node 337-1, the second node 337-2, and the third node 337-3 between the delta-connected three reactance elements 331, 332, and 333 may be electrically connected with the first ground 341, the first feeding terminal 321, and the first antenna radiator 311, respectively.

For example, the delta-connected three reactance elements 331, 332, and 333 may correspond to elements (e.g., capacitors) which are dominant with capacitive components. Capacitance of the third reactance element 333 arranged between the first node 337-1 and the third node 337-3 may be higher than capacitance of the second reactance element 332 arranged between the second node 337-2 and the third node 337-3.

According to an embodiment of the present disclosure, the passive circuit 330 may include a fourth reactance element 334 which is arranged between the first ground 341 and the first node 337-1 in series. The fourth reactance element 334 may correspond to an element (e.g., inductor) which is dominant with an inductive component.

According to an embodiment of the present disclosure, the passive circuit 330 may include a fifth reactance element 335 which is arranged between the second node 337-2 and the second ground 342 in series. The fifth reactance element 335 may correspond to an element (e.g., inductor) which is dominant with an inductive component.

According to an embodiment of the present disclosure, the passive circuit 330 may branch out from the second node 337-2 and may include a sixth reactance element 336 which is arranged between the second node 337-2 and the first feeding terminal 321 in series. The sixth reactance element may correspond to an element which is dominant with a capacitive component.

Although FIG. 3 illustrates the grounds 341, 342, 343, 351, 352, and 361 are formed individually, according to an embodiment of the present disclosure, two or more grounds may be integrated even on a single ground. Additionally, a conductive line 348, which is elongated from the first ground 341 to the fourth reactance element 334, and an area 349, which is elongated from the second ground 342 to the fifth reactance element 335, may be utilized for frequency band tuning (resonance shift) by adjusting lengths and widths.

Additionally, according to various embodiments of the present disclosure, reactance elements 331 to 336, 344, 353, 354, and 362 may be implemented in microstrip lines which has variable lengths and widths, as well as in lumped elements.

Figure 4:
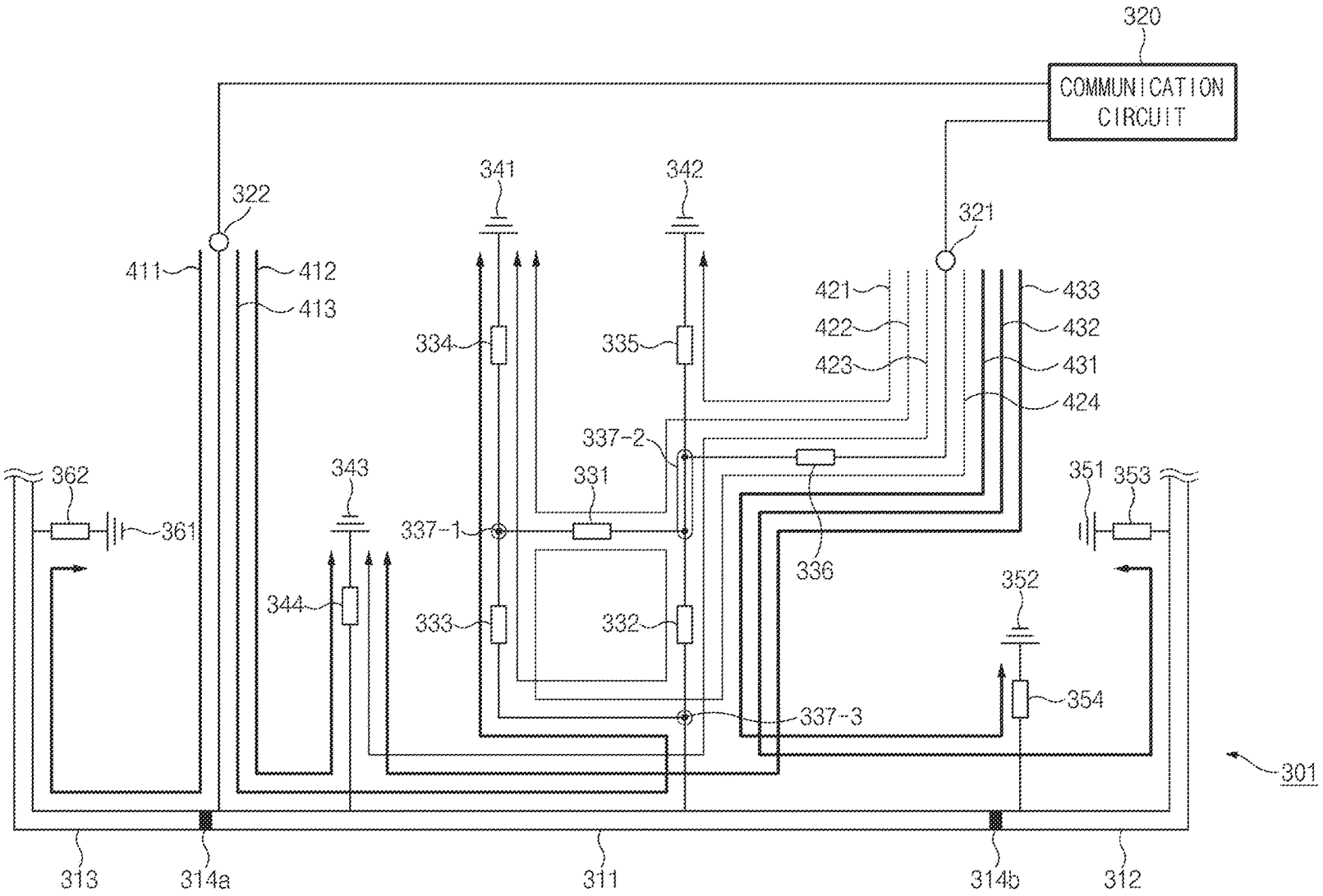
FIG. 4 illustrates electrical paths according to an embodiment of the present disclosure.

FIG. 4 illustrates electrical paths according to an embodiment of the present disclosure.

Referring to FIG. 4, a communication circuit 320 may supply a first frequency band signal and a second frequency band signal respectively to a first feeding terminal 321 and a second feeding terminal 322. Electrical paths 4111 to 413, 421 to 424, and 431 to 433 according to an embodiment of the present disclosure may be formed from the first feeding terminal 321 and the second feeding terminal 322 to grounds 341, 342, 343, 351, 352, and 361 in various ways. The electrical paths 411 to 413, 421 to 424, and 431 to 433 may not be restrictive to those shown in FIG. 4, and may be embodied even in more various forms. With respect to FIG. 4, the duplicative description relevant to FIG. 3 will be omitted hereafter.

A second frequency band signal (low frequency band signal) may be transmitted or received through the electrical paths 411, 412, and 413. A first frequency band signal (intermediate frequency band signal and high frequency band signal) may be transmitted or received through the electrical paths 421, 422, 423, 424, 431, and 433. Additionally, although not shown in FIG. 4, the first frequency band signal may be transmitted or received through an electrical path passing the first feeding 321, the sixth reactance element 336, the second node 337-2, the first reactance element 331, the first node 337-1, the third reactance element 333, the third node 337-3, the first antenna radiator 311, the second insulating member 314*b*, the reactance element 354, and the ground 352.

According to an embodiment of the present disclosure, a portion of the second frequency band signal supplied from the second feeding terminal 322 may be propagated to the first ground 341 through various paths (e.g., the electrical path 413). For example, a portion of the second frequency band signal may be propagated to the first ground 341 through a part (e.g., the electrical path 413) of the plurality of electrical paths of the passive circuit 330. For example, the electrical path 413 may correspond to an electrical path, which has the lowest reactance among the plurality of electrical paths, from the second feeding unit 322 to the first ground 341.

In the general case without a passive circuit, electrical paths transmitting or receiving a second frequency band signal may be partly superposed even on electrical paths transmitting or receiving a first frequency signal. The first frequency band signal supplied from the first feeding terminal 321 may be transmitted or received through the electrical paths 431 and 432 in a considerable portion. If an electrical path transmitting or receiving the second frequency band signal is superposed on the electrical paths 431 and 432, the first and second frequency band signals may interfere each other to degrade radiation efficiency in each frequency band (i.e., to deteriorate isolation).

Different from the general case, in the case with the passive circuit 330 according to an embodiment of the present disclosure, a portion of the second frequency band signal may be propagated to a ground (e.g., the first ground 341) through various paths (e.g., the electrical path 413). Accordingly, the electrical paths of the second frequency band signal may not affect the electrical paths 431 and 432 transmitting or receiving a considerable portion of the first frequency band signal. Therefore, it may be allowable to enhance isolation between the first frequency band signal and the second frequency band signal, thus improving radiation efficiency in each frequency band.

In the meantime, the electrical path 421 formed of the first feeding terminal 321, the sixth reactance element 336, the second node 337-2, the fifth reactance element 335, and the second ground 342 may be additionally formed with resonance of short wavelength. This may contribute to broad resonance in a high frequency band. Additionally, the electrical path 422 and the electrical path 424 may contribute to improving radiation efficiency, broad resonance as well.

Figure 5:
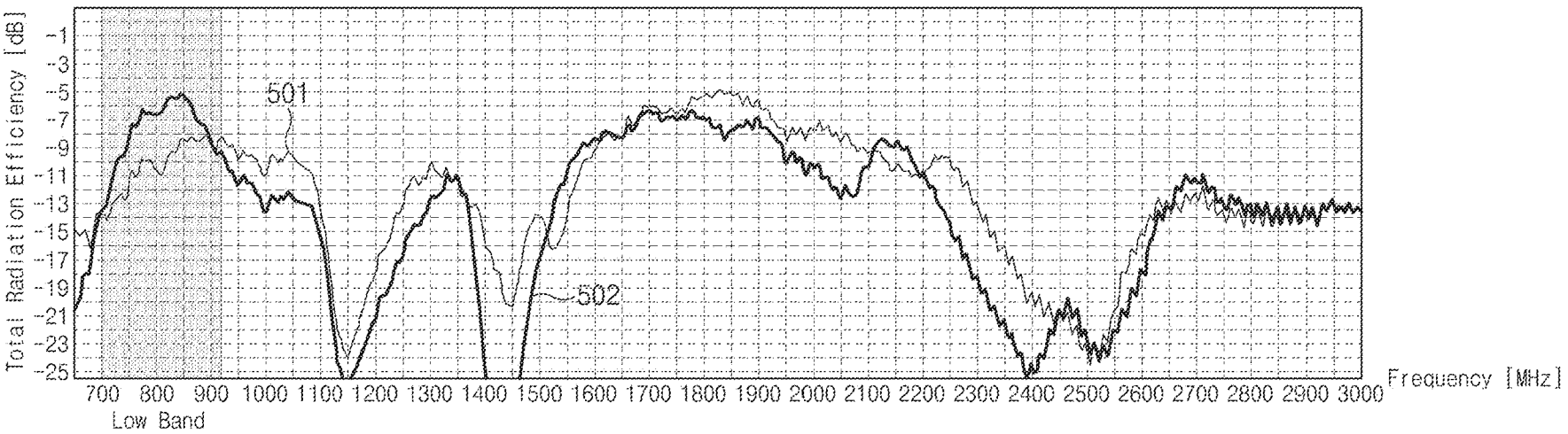
FIG. 5 is a graph showing the characteristics of low-frequency band functionality in an electronic device according to an embodiment of the present disclosure.

FIG. 5 is a graph showing the characteristics of low-frequency band functionality in an electronic device according to an embodiment of the present disclosure.

Referring to FIG. 5, curves 501 and 502 show antenna radiation efficiency (peak gain of antenna) when a low frequency band signal is transmitted or received. The curve 501 shows the case without a passive circuit (e.g., the passive circuit 330 of FIG. 3) according to an embodiment of the present disclosure, i.e., the case where the first feeding terminal 321 and the grounds 341 and 342 are directly connected with the first antenna radiator 311). Otherwise, the curve 502 shows the case with a passive circuit (e.g., the passive circuit 330 of FIG. 3) according to an embodiment of the present disclosure.

Comparing the curve 501 with the curve 502 for radiation efficiency, the curve 502 is higher as much as about 5~10 dB than the curve 501 in a low frequency band (e.g., about 700~900 MHz). Whereas, throughout almost all of the domain of a frequency band equal to or higher than about 1000 MHz, the curve 502 is lower than the curve 501 in radiation efficiency. A passive circuit (e.g., the passive circuit 330 of FIG. 3) according to an embodiment of the present disclosure may allow a low frequency band signal, which is transmitted or received, to less affect an intermediate frequency band signal or a high frequency band signal. As a result, the passive circuit may further enhance resonance functionality over almost domain of the low frequency band, thus improving isolation.

Figure 6:
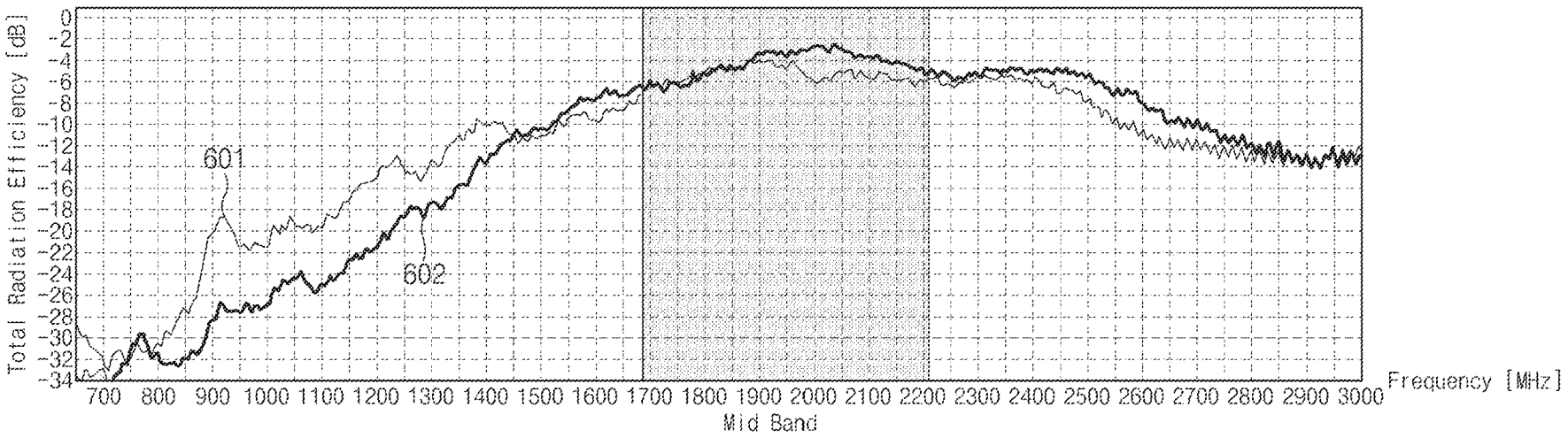
FIG. 6 is a graph showing the characteristics of mid-frequency band functionality in an electronic device according to an embodiment of the present disclosure.

FIG. 6 is a graph showing the characteristics of in term band (mid band) functionality in an electronic device according to an embodiment of the present disclosure.

Referring to FIG. 6, curves 601 and 602 show antenna radiation efficiency when an intermediate frequency band signal is transmitted or received. The curve 601 shows the case without a passive circuit (e.g., the passive circuit 330 of FIG. 3) according to an embodiment of the present disclosure, i.e., the case where the first feeding terminal 321 and the grounds 341 and 342 are directly connected with the first antenna radiator 311). The curve 602 shows the case with a passive circuit (e.g., the passive circuit 330 of FIG. 3) according to an embodiment of the present disclosure.

Comparing the curve 601 with the curve 602 for radiation efficiency, the curve 602 is higher than the curve 601 in an intermediate frequency band (e.g., about 1700~2200 MHz). Whereas, throughout almost all of the domain of a frequency band lower than about 1700 MHz, the curve 602 is lower than the curve 601 in radiation efficiency. A passive circuit (e.g., the passive circuit 330 of FIG. 3) according to an embodiment of the present disclosure may allow an intermediate frequency band signal, which is transmitted or received, to less affect a low frequency band signal and may further enhance resonance functionality over almost domain of the intermediate frequency band. As a result, the passive circuit may improve isolation.

Figure 7:
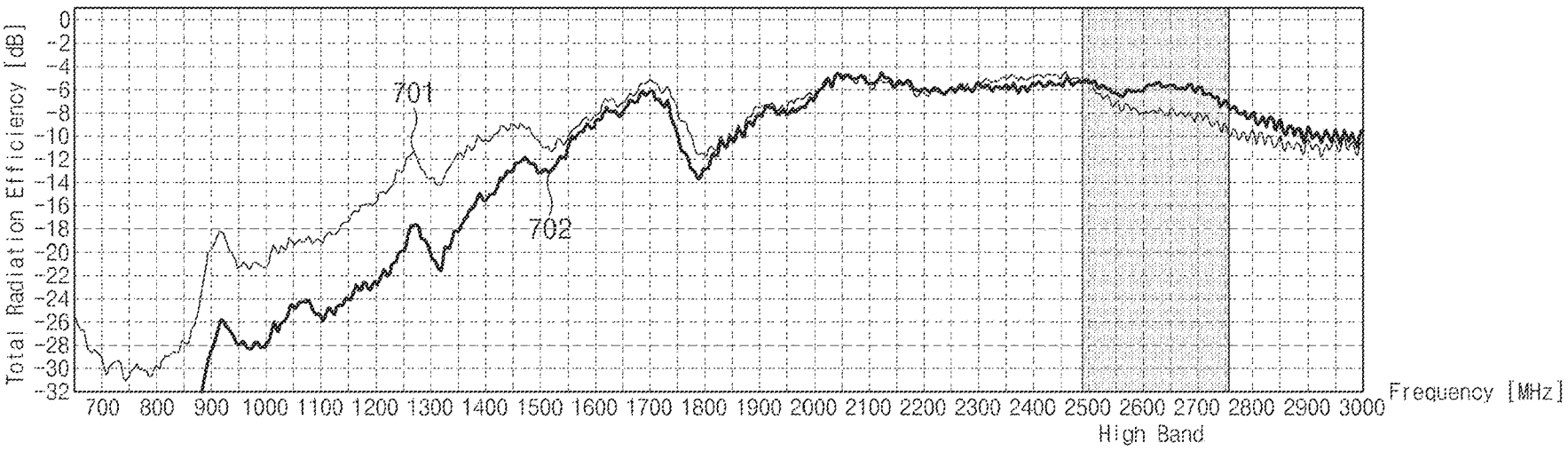
FIG. 7 is a graph showing the characteristics of high-frequency band functionality in an electronic device according to an embodiment of the present disclosure.

FIG. 7 is a graph showing the characteristics of high-frequency band functionality in an electronic device according to an embodiment of the present disclosure.

Referring to FIG. 7, curves 701 and 702 show antenna radiation efficiency when an intermediate frequency band signal is transmitted or received. The curve 701 shows the case without a passive circuit (e.g., the passive circuit 330 of FIG. 3) according to an embodiment of the present disclosure, i.e., the case where the first feeding terminal 321 and the grounds 341 and 342 are directly connected with the first antenna radiator 311). The curve 702 shows the case with a passive circuit (e.g., the passive circuit 330 of FIG. 3) according to an embodiment of the present disclosure.

Comparing the curve 701 with the curve 702 for radiation efficiency, the curve 702 is higher than the curve 701 in an intermediate frequency band (e.g., about 2500~2800 MHz). Whereas, throughout almost all of the domain of a frequency band lower than about 1800 MHz, the curve 702 is lower than the curve 701 in radiation efficiency. A passive circuit (e.g., the passive circuit 330 of FIG. 3) according to an embodiment of the present disclosure may allow a high frequency band signal, which is transmitted or received, to less affect an intermediate frequency signal or a low frequency band signal and may further enhance resonance functionality over almost domain of the high frequency band. As a result, the passive circuit may improve isolation.

Figure 8:
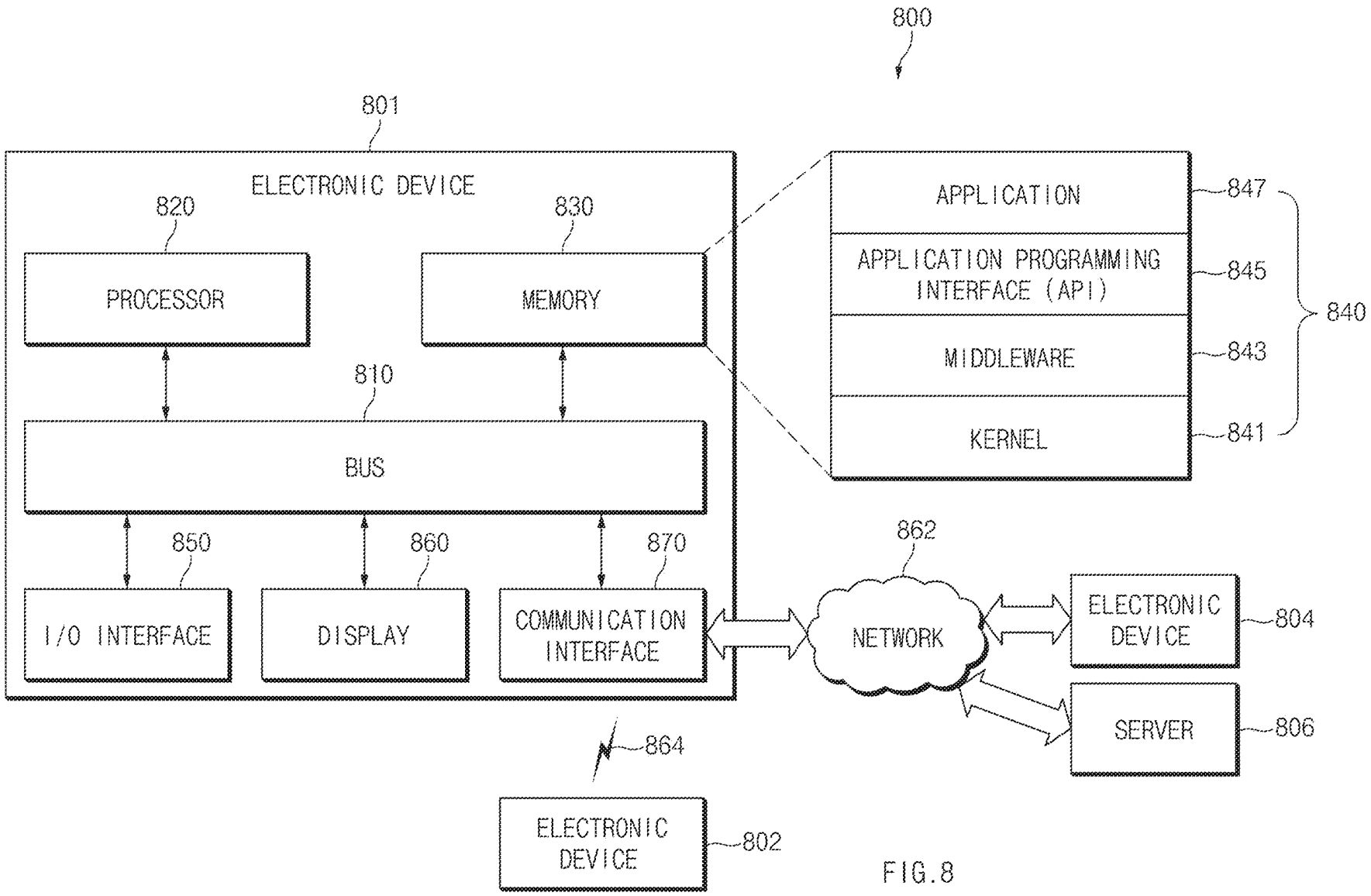
FIG. 8 is a block diagram illustrating an electronic device according to an embodiment of the present disclosure.

FIG. 8 is a block diagram illustrating an electronic device 800 according to an embodiment of the present disclosure.

Referring to FIG. 8, electronic devices 801, 802, and 804 or a server 806 may be connected each other through a network 862 or local area communication 864. The electronic device 801 may include a bus 810, a processor 820, a memory 830, an input/output (I/O) interface 850, a display 860, and a communication circuit 870. In some embodiments of the present disclosure, the electronic device 801 may exclude at least one of the elements therefrom or further include another element therein.

The bus 810, for example, may include a circuit for connecting the elements 810~870 with each other and relaying communication (control messages and/or data) between the elements.

The processor 820 may include at least one or more of a CPU, an AP, or a communication processor (CP). The processor 820, for example, may execute computation or data operation for control and/or communication of other elements of at least one of the electronic device 801.

The memory 830 may include a volatile and/or nonvolatile memory. The memory 830 may store, for example, instructions or data which are involved in at least one of other elements in the electronic device 801. According to an embodiment of the present disclosure, the memory 830 may store software and/or a program 840 therein. The program 840 may include, for example, a kernel 841, a middleware 843, an application programming interface (API) 845, and/or an application program (or "application") 847. At least a part of the kernel 841, the middleware 843, or the API 845 may be referred to as an operation system (OS).

The kernel 841 may control or manage, for example, system resources (e.g., the bus 810, the processor 820, or the memory 830) which are used for executing operations or functions implemented in other programs (e.g., the middleware 843, the API 845, or the application program 847). Additionally, the kernel 841 may provide an interface capable of controlling or managing system resources by approaching individual elements of the electronic device 801 from the middleware 843, the API 845, or the application program 847.

The middleware 843 may perform a mediating function to allow, for example, the API 845 or the application program 847 to communicate and exchange data with the kernel 841.

Additionally, in relation to one or more work requests received from the application program 847, the middleware 843 may perform, for example, a control operation (e.g., scheduling or load balancing) for the work request by using a method of designating or arranging the priority, which permits the electronic device 801 to use a system resource (e.g., the bus 810, the processor 820, or the memory 830), into at least one application of the application program 847. For example, middleware 843 may perform scheduling or load balancing operations for the one or more work requests by processing the one or more work requests in accordance with the priority.

The API 845 may be, for example, an interface for allowing the application 847 to control a function which is provided from the kernel 841 or the middleware 843. For example, the API 845 may include at least one interface or function (e.g., instructions) for file control, window control, or character control.

The I/O interface 850 may act, for example, an interface capable of transmitting instructions or data, which are input from a user or another external device, to another element (or other elements) of the electronic device 801. Additionally, the I/O interface 850 may output instructions or data, which are received from another element (or other elements) of the electronic device 801, to a user or another external device.

The display 860 may include, for example, an LCD, an LED, an OLED display, an MEMS display, or an electronic paper. The display 860 may display, for example, diverse contents (e.g., text, image, video, icon, or symbol) to a user. The display 860 may include a touch screen, and for example may receive an input of touch, gesture, approach, or hovering which is made by using an electronic pen or a part of a user's body.

The communication interface 870 may set, for example, a communication condition between the electronic device 801 and an external electronic device (e.g., a first external electronic device 802, a second external electronic device 804, or a server 806). For example, the communication interface 860 may communicate with an external electronic device (e.g., the second external electronic device 804 or the server 806) in connection with a network 862 through wireless communication or wired communication.

Wireless communication, for example, as cellular communication protocol, may include cellular communication using at least one of long-term evolution (LIE), LTE-advanced (LTE-A), code division multiple access (CDMA), wideband CDMA (WCDMA), universal mobile telecommunications system (UMTS), wireless broadband (WiBro), or global system for mobile communication (GSM). According to an embodiment of the present disclosure, the wireless communication may include, for example, at least one of Wi-Fi, Bluetooth (BT), BT low energy (BLE), ZigBee, near field communication (NEC), magnetic secure transmission (MST), radio frequency (RF), body area network (BAN), or global navigation satellite system (GNSS).

MST may generate a pulse according to transmission data by using an electromagnetic signal and the pulse may generate a magnetic field signal. The electronic device 801 may transmit the magnetic field signal to a point of sales (POS). The POS may use an MST reader to detect the magnetic field signal and may convert the detected magnetic field signal into an electrical signal to restore data.

GNSS may include, for example, at least one of GPS, global navigation satellite system (GLONASS), BeiDou navigation satellite system (hereafter, referred to as 'BeiDou'), or Galileo (the European global satellite-based navigation system) in accordance with local area or bandwidth. Hereafter, 'GPS' may be interchangeably used with 'GNSS' in the present disclosure. Wired communication may include, for example, at least one of universal serial bus (USB), high definition multimedia interface (HDMI), recommended standard-232 (RS-232), or plain old telephone service (POTS). The network 862 may include a telecommunication network, for example, at least one of computer network (e.g., local area network (LAN) or wide area network (WAN)), internet, or telephone network.

Each of the first and second external electronic devices 802 and 804 may be same with or different from the electronic device 801. According an embodiment of the present disclosure, the server 806 may include a group of one or more servers. According to various embodiments of the present disclosure, all or a part of operations executed in the electronic device 801 may be executed in another one or a plurality of electronic devices (e.g., the electronic device 802 or 804, or the server 806). According to an embodiment of the present disclosure, in case there is a need of performing a function or service automatically or by a request for the electronic device 801, the electronic device 801 may request at least a part of the function or service, additionally or instead of executing by itself, from another device (e.g., the electronic device 802 or 804, or the server 806). Such another device (e.g., the electronic device 802 or 804, or the sever 806) may execute such a requested or additional function and then send a result of the execution of the function. The electronic device 801 may process a received result, as it is or additionally, to provide the requested function or service. To this end, for example, it may be available to adopt a cloud computing, distributed computing, or client-server computing technique.

Figure 9:
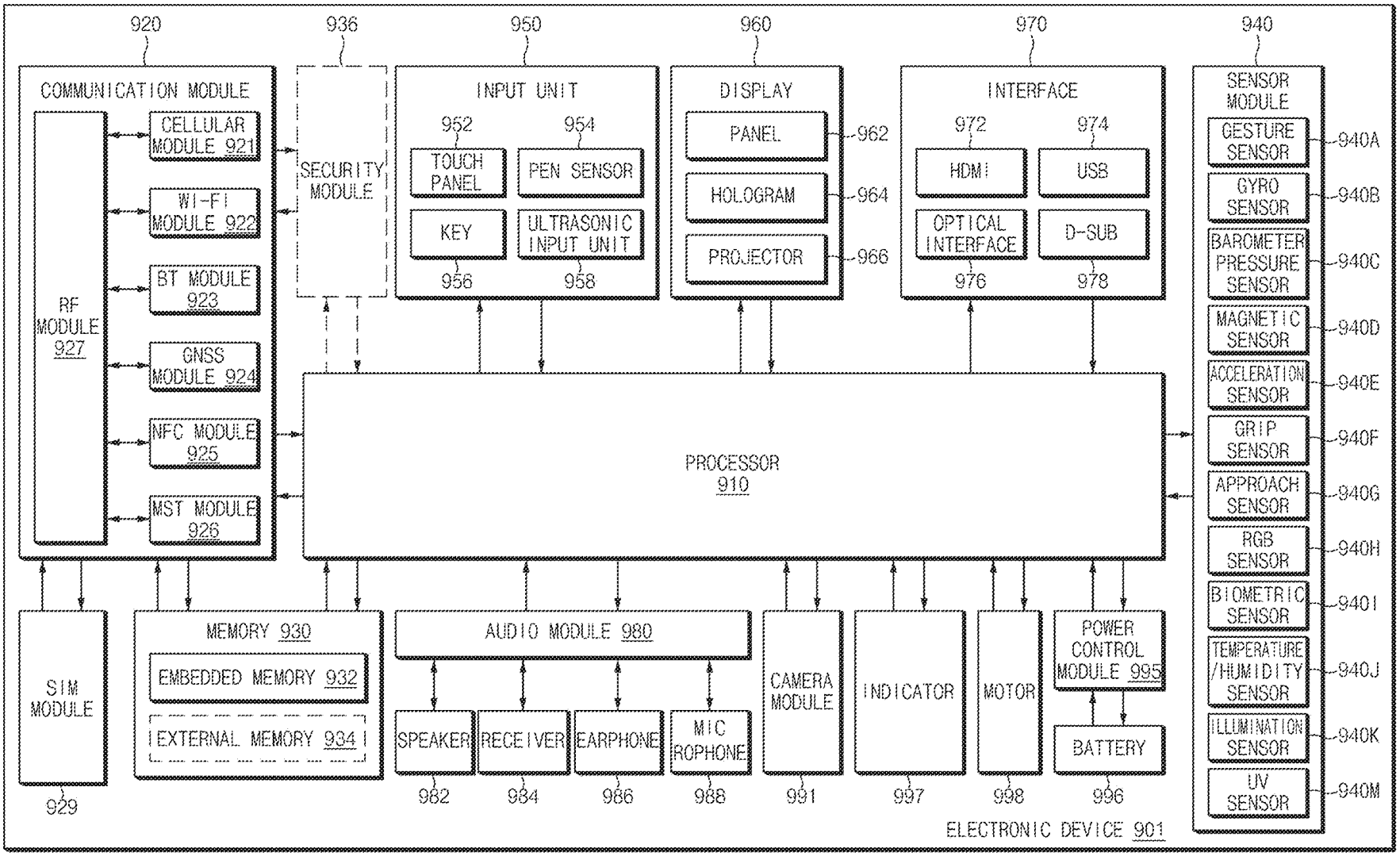
FIG. 9 is a block diagram illustrating an electronic device according to an embodiment of the present disclosure.

FIG. 9 is a block diagram illustrating an electronic device according to an embodiment of the present disclosure.

Referring to FIG. 9, the electronic device 901 may include, for example, all or a part of elements of the electronic device 801 shown in FIG. 8. The electronic device 901 may include one or more APs 910, a communication module 920, a subscriber identification module (SIM) card 929, a memory 930, a sensor module 940, an input unit 950, a display 960, an interface 970, an audio module 980, a camera module 991, a power management module 995, a battery 996, an indicator 997, or a motor 998.

The AP 910 may drive an OS or an application to control a plurality of hardware or software elements connected to the processor 910 and may process and compute a variety of data including multimedia data. The processor 910 may be implemented with a system-on-chip (SoC), for example. According to an embodiment of the present disclosure, the processor 910 may further include a graphics processing unit (GPU) and/or an image signal processor (ISP). The processor 910 may even include at least a part of the elements shown in FIG. 9. The processor 910 may process instructions or data, which are received from at least one of other elements (e.g., a nonvolatile memory), and then store diverse data into such a nonvolatile memory.

The communication module 920 may have a configuration same with or similar to the communication interface 870 of FIG. 8. The communication module 920 may include a cellular module 921, a Wi-Fi module 922, a BT module 923, a GNSS module 924 (e.g., GPS module, GLONASS module, BeiDou module, or Galileo module), an NFC module 925, an MST module 926, and an RF module 927.

The cellular module 921 may provide voice call, video call, a character service, or an Internet service through a communication network. According to an embodiment of the present disclosure, the cellular module 921 may perform discrimination and authentication of an electronic device within a communication network using an SIM (e.g., a SIM card) 929. According to an embodiment of the present disclosure, the cellular module 921 may perform at least a portion of functions that the processor 910 provides. According to an embodiment of the present disclosure, the cellular module 921 may include a CP.

Each of the Wi-Fi module 922, the BT module 923, the GNSS module 924, the NFC module 925, or the MST module 926 may include, for example, a processor for processing data transmitted or received through a corresponding module. In some embodiments of the present disclosure, at least a part (e.g., two or more elements) of the cellular module 921, the Wi-Fi module 922, the BT module 923, the GNSS module 924, the NFC module 925, or the MST module 926 may be included within one integrated circuit (IC) or an IC package.

The RF module 927 may transmit or receive, for example, communication signals (e.g., RF signals). The RF module 927 may include a transceiver, a power amplifier module (PAM), a frequency filter, a low noise amplifier (LNA), or an antenna. According to an embodiment of the present disclosure, at least one of the cellular module 921, the Wi-Fi module 922, the BT module 923, the GNSS module 924, the NFC module 925, or the MST module 926 may transmit or receive an RF signal through a separate RF module.

The SIM card 929 may include, for example, a card, which has a subscriber identification module, and/or an embedded SIM, and include unique identifying information (e.g., IC card identifier (ICCID)) or subscriber information (e.g., integrated mobile subscriber identity (IMSI)).

The memory 930 (e.g., the memory 830) may include, for example, an embedded memory 932 or an external memory 934. For example, the embedded memory 932 may include, for example, at least one of a volatile memory (e.g., a dynamic random access memory (DRAM), a static RAM (SRAM), a synchronous dynamic RAM (SDRAM), etc.), a nonvolatile memory (e.g., a one-time programmable read-only memory (OTPROM), a programmable ROM (PROM), an erasable and programmable ROM (EPROM); an electrically erasable and programmable ROM (EEPROM), a mask ROM, a flash ROM, a NAND flash memory, a NOR flash memory, etc.), a hard drive, or solid state drive (SSD).

The external memory 934 may further include a flash drive, for example, a compact flash (CF), a secure digital (SD), a micro-SD, a mini-SD, an extreme digital (xD), or a memory stick. The external memory 934 may be functionally and/or physically connected with the electronic device 901 through various interfaces.

A security module 936, as a module including a storage space which is higher than the memory 930 in security level, may be a circuit for securing safe data storage and protected execution circumstances. The security module 936 may be implemented with an additional circuit and may include an additional processor. The security module 936, for example, may be present in an attachable smart chip or SD card, or may include an embedded secure element (eSE) which is installed in a fixed chip. Additionally, the security module 936 may be driven in another OS which is different from the OS of the electronic device 901. For example, the security module 936 may operate based on a java card open platform (JCOP) OS.

The sensor module 940 may measure, for example, a physical quantity, or detect an operation state of the electronic device 901, to convert the measured or detected information to an electric signal. The sensor module 940 may include at least one of a gesture sensor 940A, a gyro sensor 940B, a barometer pressure sensor 940C, a magnetic sensor 940D, an acceleration sensor 940E, a grip sensor 940F, a proximity sensor 940G, a color sensor 940H (e.g., red, green, blue (RGB) sensor), a biometric sensor 940I, a temperature/humidity sensor 940J, an illuminance sensor 940K, or an UV sensor 940M. Additionally or alternatively, though not shown, the sensor module 940 may further include an E-nose sensor, an electromyography sensor (EMG) sensor, an electroencephalogram (EEG) sensor, an electrocardiogram (ECG) sensor, an infrared (IR) sensor, an iris sensor, or a fingerprint sensor, for example. The sensor module 940 may further include a control circuit for controlling at least one or more sensors included therein. In some embodiments of the present disclosure, the electronic device 901 may further include a processor, which is configured to control the sensor module 940, as a part or additional element, thus controlling the sensor module 940 while the processor 910 is in a sleep state.

The input unit 950 may include, for example, a touch panel 952, a (digital) pen sensor 954, a key 956, or an ultrasonic input unit 958. The touch panel 952 may recognize, for example, a touch input using at least one of a capacitive type, a resistive type, an infrared type, or an ultrasonic wave type. Additionally, the touch panel 952 may further include a control circuit. The touch panel 952 may further include a tactile layer to provide a tactile reaction for a user.

The (digital) pen sensor 954 may be a part of the touch panel 952, or a separate sheet for recognition. The key 956, for example, may include a physical button, an optical key, or a keypad. The ultrasonic input unit 958 may detect an ultrasonic wave, which is generated from an input instrument, through a microphone (e.g., a microphone 988) to confirm data corresponding to the detected ultrasonic signal.

The display 960 (e.g., the display 860) may include a panel 962, a hologram device 964, or a projector 966. The panel 962 may include the same or similar configuration with the display 860 of FIG. 8. The panel 962, for example, may be implemented to be flexible, transparent, or wearable. The panel 962 and the touch panel 952 may be implemented in one module. The hologram device 964 may show a three-dimensional image in a space using interference of light. The projector 966 may project light onto a screen to display an image. The screen, for example, may be positioned in the inside or outside of the electronic device 901. According to an embodiment of the present disclosure, the panel 962 may include a pressure sensor (or force sensor) for measuring a force of pressure to a user's touch. The pressure sensor may be integrated in one body with the touch panel 952 or may be an additional one or more sensor independent from the touch panel 952. According to an embodiment of the present disclosure, the display 960 may further include a control circuit for controlling the panel 962, the hologram device 964, or the projector 966.

The interface 970 may include, for example, an 972, an USB 974, an optical interface 976, or a D-subminiature (D-sub) 978. The interface 970 may include, for example, the communication circuit 870 shown in FIG. 8. Additionally or alternatively, the interface 970, for example, may include a mobile high definition link (MHL) interface, an SD card/multi-media card (MMC) interface, or an infrared data association (IrDA) standard interface.

The audio module 980 may convert a sound and an electric signal in dual directions. At least one element of the audio module 980 may include, for example, the I/O interface 850 shown in FIG. 8. The audio module 980, for example, may process sound information that is input or output through the speaker 982, the receiver 984, the earphone 986, or the microphone 988.

The camera module 991 may be a unit which is capable of taking a still picture and a moving picture. According to an embodiment of the present disclosure, the camera module 991 may include one or more image sensors (e.g., a front sensor or a rear sensor), a lens, an ISP, or a flash (e.g., an LED or a xenon lamp).

The power management module 995 may manage, for example, power of the electronic device 800. The power management module 895 may include, for example, a power management IC (PMIC) a charger IC, or a battery or fuel gauge. The PMIC may operate in wired and/or wireless charging mode. A wireless charging mode may include, for example, diverse types of magnetic resonance, magnetic induction, or electromagnetic wave. For the wireless charging, an additional circuit, such as a coil loop circuit, a resonance circuit, or a rectifier, may be further included therein. The battery gauge, for example, may measure a remnant of the battery 996, a voltage, a current, or a temperature during charging. The battery 996 may measure, for example, a residual, a voltage on charge, a current, or temperature thereof. The battery 996 may include, for example, a rechargeable battery and/or a solar battery.

The indicator 997 may display the following specific state of the electronic device 901 or a part (e.g., the processor 910) thereof: a booting state, a message state, or a charging state. The motor 998 may convert an electric signal into mechanical vibration and generate a vibration or haptic effect. Although not shown, the electronic device 800 may include a processing unit (e.g., a GPU) for supporting a mobile TV. The processing unit for supporting the mobile TV, for example, may process media data that is based on the standard of digital multimedia broadcasting (DMB), digital video broadcasting (DVB), or media flow (MediaFlo™).

Each of the above-described elements of the electronic device according to an embodiment of the present disclosure may be implemented using one or more components, and a name of a relevant component may vary with on the kind of the electronic device. The electronic device according to various embodiments of the present disclosure may include at least one of the above components. Also, a part of the components may be omitted, or additional other components may be further included. Also, some of the components of the electronic device according to the present disclosure may be combined to form one entity, thereby making it possible to perform the functions of the relevant components substantially the same as before the combination.

As described above, an electronic device according to an embodiment of the present disclosure may include an antenna radiator, a first feeding terminal configured to supply a first frequency band signal to the first antenna radiator, a second feeding terminal configured to supply a second frequency band signal to the first antenna radiator, and a plurality of grounds electrically connected with the antenna radiator. The first feeding terminal may be connected with the antenna radiator and at least one of the grounds through a passive circuit including a plurality of electrical paths.

In an embodiment of the present disclosure, the first frequency band may be higher than the second frequency band.

In an embodiment of the present disclosure, the plurality of electrical paths of the passive circuit may include at least one passive element. The at least one passive element may include a reactance element.

In an embodiment of the present disclosure, a portion of the second frequency band signal supplied from the second feeding terminal may be propagated to the at least one ground through a part of the plurality of electrical paths.

In an embodiment of the present disclosure, a portion of the second frequency band signal supplied from the second feeding terminal may be propagated to the at least one ground through an electrical path having the lowest reactance among the plurality of electrical paths.

In an embodiment of the present disclosure, the electronic device may further include a housing that has at least a part formed by a conductive member. At least a part of the antenna radiator may correspond to the conductive member.

In an embodiment of the present disclosure, the electronic device may further include a communication circuit configured to supply the first frequency band signal and the second frequency band signal to the first feeding terminal and the second feeding terminal. The communication circuit may be configured to transmit or receive the first frequency band signal and the second frequency band signal in a MUM scheme.

An electronic device according to an embodiment of the present disclosure may include an antenna radiator, a first feeding terminal and a second feeding terminal that supply (or feed) frequency signals to the antenna radiator, a passive circuit arranged between the first feeding terminal and the antenna radiator, and a communication circuit electrically connected with the first feeding terminal and the second feeding terminal. The communication circuit may be configured to transmit or receive a first frequency band signal through a first electrical path that is formed of the first feeding terminal and at least a part of the antenna radiator, and to transmit or receive a second frequency band signal through a second electrical path that is formed of the second feeding terminal and at least a part of the antenna radiator. The passive circuit may be configured to enhance isolation between the first frequency band signal and the second frequency band signal.

In an embodiment of the present disclosure, the passive circuit may include delta-connected three reactance elements. A first node, a second node, and a third node between the delta-connected three reactance elements may be electrically connected with a first ground, the first feeding terminal, and the antenna radiator, respectively.

In an embodiment of the present disclosure, the delta-connected three reactance elements may be dominant with capacitive components.

In an embodiment of the present disclosure, capacitance of a reactance element arranged between the first node and the third node may be higher than that of a reactance element arranged between the second node and the third node.

In an embodiment of the present disclosure, the passive circuit may further include a reactance element that is arranged between the first ground and the first node in series. The reactance element serially arranged between the first ground and the first node may be dominant with an inductive component.

In an embodiment of the present disclosure, the passive circuit may further include a reactance element that is arranged between the second node and the first feeding terminal in series. The reactance element serially arranged between the second node and the first feeding terminal may be dominant with a capacitive component.

In an embodiment of the present disclosure, the passive circuit may further include a reactance element that is arranged between the second node and a second ground in series. The reactance element arranged between the second node and the second ground may be dominant with an inductive component.

An electronic device according to an embodiment of the present disclosure may include a first antenna radiator, a second antenna radiator, a first insulating member arranged between the first antenna radiator and the second antenna, a first feeding terminal and a second feeding terminal that supply frequency signals (or feed) to the first antenna radiator, a passive circuit arranged between the first feeding terminal and the first antenna radiator, and a communication circuit electrically connected with the first feeding terminal and the second feeding terminal. The communication circuit may be configured to transmit or receive a first frequency band signal through a first electrical path that is formed of the first feeding terminal, the first antenna radiator, and the second antenna radiator and to transmit or receive a second frequency band signal through a second electrical path that is formed of the second feeding terminal and the first antenna radiator. The passive circuit may be configured to enhance isolation between the first frequency band signal and the second frequency band signal.

In an embodiment of the present disclosure, the first antenna radiator and the second antenna radiator may be electrically coupled via the first insulating member.

In an embodiment of the present disclosure, the electronic device may further include a third antenna radiator electrically coupled with the first antenna radiator, and a second insulating member arranged between the first antenna radiator and the third antenna radiator. The second feeding terminal, the first antenna radiator, and the third antenna radiator may be configured to form a third electrical path for transmitting or receiving a third frequency band signal.

The term "module" used for the present disclosure, for example, may mean a unit including one of hardware, software, and firmware or a combination of two or more thereof. A "module", for example, may be interchangeably used with terminologies such as a unit, logic, a logical block, a component, a circuit, etc. The "module" may be a minimum unit of a component integrally configured or a part thereof. The "module" may be a minimum unit performing one or more functions or a portion thereof. The "module" may be implemented mechanically or electronically. For example, the "module" according to various embodiments of the present disclosure may include at least one of an application-specific IC (ASIC) chip performing certain operations, a field-programmable gate arrays (FPGAs), or a programmable-logic device, those of which have been known or to be developed in the future.

At least a part of an apparatus (e.g., modules or functions thereof) or a method (e.g., operations) according to various embodiments of the present disclosure, for example, may be implemented by instructions stored in a computer-readable storage medium in the form of a programmable module. The instruction, when executed by a processor (e.g., the processor 820), may perform a function corresponding to the instruction. Such a computer-readable medium may be, for example, the memory 830.

The computer-readable recording medium may include a hard disk, a magnetic media such as a floppy disk and a magnetic tape, an optical media such as compact disc ROM (CD-ROM) and a DVD, a magneto-optical media such as a floptical disk, and the following hardware devices specifically configured to store and perform a program instruction (e.g., a programming module): ROM, RAM, and a flash memory. Also, a program instruction may include not only a mechanical code such as things generated by a compiler but also a high-level language code executable on a computer using an interpreter. The above hardware unit may be configured to operate via one or more software modules for performing an operation of the present disclosure, and vice versa.

A module or a programming module according to various embodiments of the present disclosure may include at least one of the above elements, or a part of the above elements may be omitted, or additional other elements may be further included. Operations performed by a module, a programming module, or other elements according to an embodiment of the present disclosure may be executed sequentially, in parallel, repeatedly, or in a heuristic method. Also, a portion of operations may be executed in different sequences, omitted, or other operations may be added thereto.

According to embodiments of the present disclosure, it may be accomplishable for an electronic device to improve isolation between a first frequency band signal and a second frequency band signal and to form broad resonance over diverse frequency bands, as well as enhancing radiation efficiency. Additionally, other various effects may be provided through advantages that are found directly or indirectly throughout embodiments of the present disclosure.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

an antenna radiator;

a first feeding terminal and a second feeding terminal configured to feed the antenna radiator;

a passive circuit arranged between the first feeding terminal and the antenna radiator; and a communication circuit electrically connected with the first feeding terminal and the second feeding terminal, wherein the communication circuit is configured to:

transmit and receive a first frequency band signal through a first electrical path that is formed of the first feeding terminal and at least a part of the antenna radiator, and transmit and receive a second frequency band signal through a second electrical path that is formed of the second feeding terminal and at least a part of the antenna radiator, wherein the passive circuit is configured to enhance isolation between the first frequency band signal and the second frequency band signal, wherein the passive circuit comprises delta-connected three reactance elements forming a first node, a second node and a third node, and wherein the first node, the second node, and the third node between the delta-connected three reactance elements are electrically connected with a first ground, the first feeding terminal, and the antenna radiator, respectively.

2. The electronic device of claim 1, wherein the delta-connected three reactance elements are dominant with capacitive components.

3. The electronic device of claim 2, wherein capacitance of a reactance element arranged between the first node and the third node is higher than that of a reactance element arranged between the second node and the third node.

4. The electronic device of claim 1, wherein the passive circuit further comprises a reactance element that is arranged between the first ground and the first node in series.

5. The electronic device of claim 4, wherein the reactance element arranged between the first ground and the first node is dominant with an inductive component.

6. The electronic device of claim 1, wherein the passive circuit further comprises a reactance element that is arranged between the second node and the first feeding terminal in series.

7. The electronic device of claim 6, wherein the reactance element arranged between the second node and the first feeding terminal is dominant with a capacitive component.

8. An electronic device comprising:

a first antenna radiator;

a second antenna radiator;

a first insulating member arranged between the first antenna radiator and the second antenna radiator;

a first feeding terminal and a second feeding terminal configured to feed the first antenna radiator;

a passive circuit arranged between the first feeding terminal and the first antenna radiator; and a communication circuit electrically connected with the first feeding terminal and the second feeding terminal, wherein the communication circuit is configured to:

transmit and receive a first frequency band signal through a first electrical path that is formed of the first feeding terminal, the first antenna radiator, and the second antenna radiator, and transmit and receive a second frequency band signal through a second electrical path that is formed of the second feeding terminal and the first antenna radiator, wherein the passive circuit is configured to enhance isolation between the first frequency band signal and the second frequency band signal, wherein the passive circuit comprises delta-connected three reactance elements forming a first node, a second node and a third node, and wherein the first node, the second node, and the third node between the delta-connected three reactance elements are electrically connected with a first ground, the first feeding terminal, and the antenna radiator, respectively.

9. The electronic device of claim 8, wherein the first antenna radiator and the second antenna radiator are electrically coupled via the first insulating member.

10. The electronic device of claim 8, further comprising:

a third antenna radiator electrically coupled with the first antenna radiator; and a second insulating member arranged between the first antenna radiator and the third antenna radiator, wherein the second feeding terminal, the first antenna radiator, and the third antenna radiator are configured to form a third electrical path for transmitting or receiving a third frequency band signal.

* * * * *